US012458157B2

(12) United States Patent
Bausby-Tanner

(10) Patent No.: US 12,458,157 B2
(45) Date of Patent: Nov. 4, 2025

(54) VARIABLE-LOOK BEDDING

(71) Applicant: Bridgette Bausby-Tanner, Olathe, KS (US)

(72) Inventor: Bridgette Bausby-Tanner, Olathe, KS (US)

( * ) Notice: Subject to any disclaimer, the term of this patent is extended or adjusted under 35 U.S.C. 154(b) by 158 days.

(21) Appl. No.: 18/386,988

(22) Filed: Nov. 3, 2023

(65) Prior Publication Data

US 2025/0143491 A1 May 8, 2025

(51) Int. Cl.
*A47G 9/02* (2006.01)

(52) U.S. Cl.
CPC ..... *A47G 9/0223* (2013.01); *A47G 9/0246* (2013.01); *A47G 9/0253* (2013.01); *A47G 9/0261* (2013.01)

(58) Field of Classification Search
CPC ..... A47G 9/02; A47G 9/0223; A47G 9/0238; A47G 9/0246; A47G 9/0253; A47G 9/0261; A47G 9/0207; A47G 9/04; A47G 2009/0269; A47G 2009/004; A47G 2200/10; A47G 9/0284; A47G 2009/001; A47D 15/001
USPC ..... 5/501, 502, 482, 489, 485, 496, 495
See application file for complete search history.

(56) References Cited

U.S. PATENT DOCUMENTS

| | | | | |
|---|---|---|---|---|
| 11,490,748 | B1 * | 11/2022 | Ogedengbe | A47G 9/0261 |
| 2016/0220047 | A1 * | 8/2016 | Stang | A47G 9/0253 |
| 2020/0060447 | A1 * | 2/2020 | Fravel | A47G 9/0261 |
| 2022/0031098 | A1 * | 2/2022 | Nagy | A47G 9/023 |

* cited by examiner

*Primary Examiner* — Justin C Mikowski
*Assistant Examiner* — Madison Emanski
(74) *Attorney, Agent, or Firm* — Invention Protection Associates, LLC

(57) ABSTRACT

Variable-look bedding set items, such as sheets, blankets, pillowcases, duvet covers and the like that are invertible into multiple right faces which each bear different appearances so that a variety of aesthetic design combinations can be achieved using the same set of bedding items without substituting any item within the set for another item that is structurally similar, but aesthetically different.

19 Claims, 1 Drawing Sheet

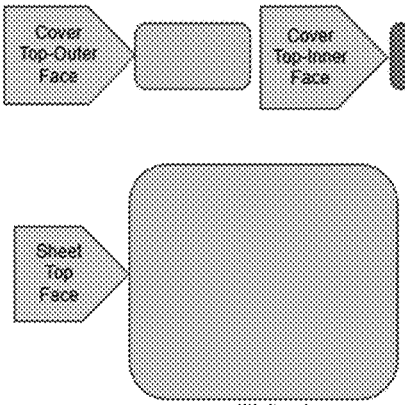
FIG. 1
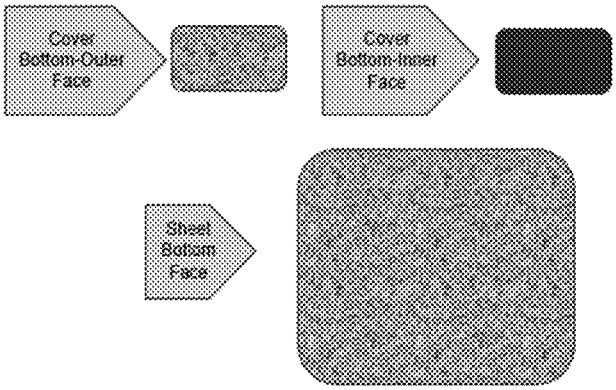
FIG. 2
FIG. 3
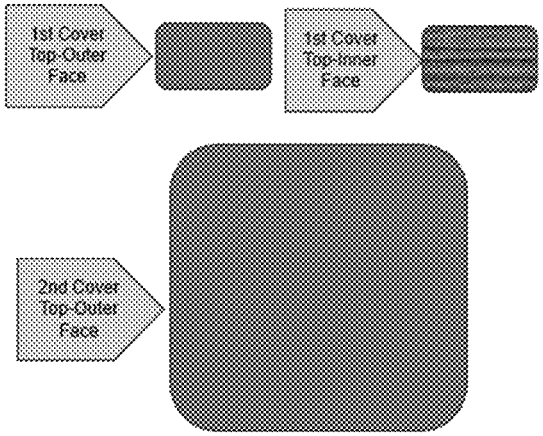
FIG. 4
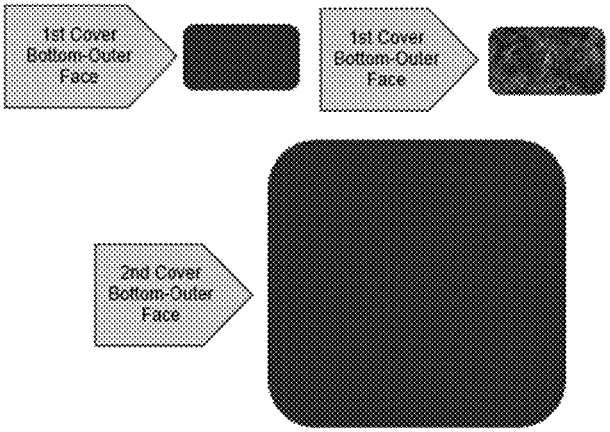

VARIABLE-LOOK BEDDING

BACKGROUND OF THE INVENTION

Bedding set items, such as bed sheets, top sheets, blankets, comforters (or "duvets" and their covers), and pillowcases, are made not only to serve the utilitarian functions of maintaining the cleanliness of mattresses, pillows and, duvets (due to their washability) and providing user warmth, they are made to provide the aesthetic functions of rendering a certain overall appearance of the living spaces they are found within and of being artistic expressions of the living space operators ("operators" meaning living space owners, renters, proprietors, and even temporary occupants)—to create impressions upon other observers and/or for the enjoyment of the living space operators themselves.

To that aesthetic point, these bedding set items are each fabricated from a variety of materials, such as cotton, silk, or cotton/polyester blends of various different weave patterns and thread counts, and they are produced in a virtually infinite number of distinct colors and graphic designs in order to, to some degree of likelihood, give them distinct appearances relative to other such bedding items that one might happen to observe. Of course, the actual probability that a given bedding item or set of bedding items will look uniquely different from all the others that a given person encounters during the normal course of that person's lifetime is a function of the manufactured quantity of items having that exact appearance. So, for a single bedding item, aesthetic uniqueness is enhanced by the scarcity of a particular manufactured design ("design" in the sense of visible surface pattern and/or coloration), and for a set of bedding items, uniqueness is enhanced by both manufactured design scarcity and design combination differences in the constituent items of the set.

Of course, increasing the probability of [observed] uniqueness of deployed bedding items, as well as the practical consideration of being able to adorn a bed, pillow, duvet, etc. with bedclothes whilst previously used ones are removed from view to be cleaned dictates that living space operators possess multiple (at least two) sets of bedding items. And the present inventor recognizes that that probability can be almost exponentially increased by producing individual bedding items to be able to take on selectively different appearances.

Consequently, the present inventor recognizes a need for bedding items (and by "bedding items," ones means not only fabric items commonly used to adorn or envelop bed elements, such as [flat or fitted] sheets, pillowcases, and duvet covers, but also some bed elements, themselves (e.g., duvets), and even fabrics not necessarily intended for use in the bedroom space (e.g., certain toss pillow covers). The present inventor further recognizes that that need is fulfilled by producing these items to be fully reversible such that all of their viewable sides appear distinctly different from each other. The present invention for variable-look bedding substantially fulfills these needs.

SUMMARY OF THE INVENTION

It is an object of the present invention to provide bedding items that are constructed to facilitate selective presentation of multiple, noticeably different appearance so that one article of bedding can be observed to have two separate looks (in the case of, for example, a bedsheet) or four separate looks (in the case of, for example, a pillowcase). It is another object of the invention to, thereby, provide a set of bedding items that, in the overall appearance of their combination, provide six separate looks (in the case of two-piece, bedsheet and pillowcase bedding set) and many more distinct looks when additional pieces are incorporated into the set (e.g., comforter and/or more sheets and/or pillowcases).

In one aspect, a bedding sheet of the present invention—be it a fitted sheet or a flat sheet—has an opposing two faces that are both so called "right faces" in that they are each dyed, printed, or embroidered with the intent that they can each be outwardly positioned for viewing (as opposed to being in mattress facing position). One way that this can be accomplished is by the sheet being formed of double cloth in which two layer-sets of warp yarns are bonded together by one or two sets of weft yarns and in which the opposing outer faces of both fabric layers are decoratively, but differently, designed.

In another aspect, a cover element of the present invention (where "cover" may be broadly interpreted as a fabric construction which forms an open-ended or closeable pocket within which a cushioned article is to be enveloped (e.g., a pillow or duvet) has four right faces formed by a first side having separately designed inner and outer faces and a second side which also has separately designed inner and outer faces.

BRIEF DESCRIPTION OF THE DRAWINGS

FIG. 1 is a schematic view of the respective top faces of a two-piece variable-look bedding set of the present invention-a set having a two-faced (top and bottom) sheet and a four-faced (top inner & outer and bottom inner & outer) cover;

FIG. 2 is a schematic view of the respective bottom faces of the same;

FIG. 3 is a schematic view of the respective top faces of a two-piece variable-look bedding set of the present invention-a set having a four-faced smaller cover and a four-faced larger cover; and FIG. 4 is a schematic view of the respective bottom faces of the same;

DETAILED DESCRIPTION OF THE PREFERRED EMBODIMENTS

The present invention generally relates to bedding items, and it is specifically directed to bedding items configured to be invertible and have multiple, distinctly designed "right" faces. In the descriptions and claims that follow and accompanying illustrations, the invention will be described as either: (a) an at least two-piece set of bedding items, where one piece is broadly referred to as a "cover," and another piece is broadly referred to as a "sheet"; or (b) an at least two-piece set of bedding items formed of two separate covers-typically, a larger one for enveloping a comforter and a smaller one for enveloping a pillow. Nevertheless, a bedding set could contain more than just two pieces, or the invention could be drawing to a single invertible cover piece. Moreover, it should be understood that a "sheet" can be a fabric sheet, comforter (or duvet), blanket, quilt, or the like, and that a "cover" could be a pillow cover (pillowcase), duvet cover, or the like.

In the preferred embodiment depicted in FIGS. 1 & 2, the present invention is a bedding set that features a cover and a sheet. The cover is a pillowcase that has four distinctly designed right faces (i.e., outwardly presentable surfaces): a top-outer face 2, a bottom-outer face 4, a top-inner face 6, and a bottom-inner face 8. Each of these faces is distinguishable from the three others in terms of graphic design and/or color. The sheet is a flat sheet having two distinct right faces: a top face 12 and bottom face 14. These sheet faces are distinguishable in their appearances.

In the preferred embodiment depicted in FIGS. 3 & 4, the present invention is a bedding set featuring a first cover and a second cover—each having the four distinct right faces previously described: Here, the first cover is a pillowcase, and the second cover is a duvet or comforter cover. Both are invertible in the sense that they can be flipped over or turned inside out to enable selection of a different bedding look to be outwardly and upwardly facing.

Additionally, within the scope of the present invention is the notion that the edges of covers can have trim (not shown) extending from them so as to both provide additional decoration and to inhibit simultaneous viewing of opposing, possibly incongruently designed sides of a pillow from any likely vantage point. It is anticipated that the trim would be attached (typically, sewn) to the pillow cover along the seams that constitute meeting lines between opposing faces of the cover.

What is claimed is:

1. A bedding set comprising: a first invertible cover for enveloping a first article, wherein this first invertible cover is formed by a first side that, itself, has inner and outer surfaces and an opposing second side that, itself, has inner and outer surfaces, wherein the first side inner, first side outer, second side inner, and second side outer surfaces are each designed substantially different from each other; a second invertible cover for enveloping a second article, wherein this second invertible cover is formed by a first side that, itself, has inner and outer surfaces and an opposing second side that, itself, has inner and outer surfaces, and wherein the first side inner, first side outer, second side inner, and second side outer surfaces of this second invertible cover are each designed substantially different from each other; and a sheet having a first side and an opposing second side, wherein the first and second sides of the sheet are designed substantially different from each other.

2. The bedding set of claim 1, wherein at least one of said invertible covers is adapted to envelop a comforter.

3. The bedding set of claim 1, wherein at least one of said invertible covers is adapted to envelop a pillow.

4. The bedding set of claim 1, wherein the substantial differences in the respective designs of the first side inner, first side outer, second side inner, and second side outer surfaces of at least one of said invertible covers are coloration differences.

5. The bedding set of claim 1, wherein the substantial differences in the respective designs of the first side inner, first side outer, second side inner, and second side outer surfaces of at least one of said invertible covers are graphic design differences.

6. The bedding set of claim 1, wherein the substantial differences in the respective designs of the first and second sides of said sheet are coloration differences.

7. The bedding set of claim 1, wherein the substantial differences in the respective designs of the first and second sides of said sheet are graphic design differences.

8. The bedding set of claim 1, further comprising trim disposed along meeting lines of the first and second sides of at least one of said invertible covers.

9. The bedding set of claim 1, further comprising trim disposed along meeting lines of the first and second sides of said sheet.

10. The bedding set of claim 1, wherein the first and second sides of at least one of said invertible covers are each formed of discrete layers of fabric.

11. The bedding set of claim 1, wherein the first and second sides of said sheet are each formed of discrete layers of fabric.

12. The bedding set of claim 1, wherein said sheet is a comforter.

13. A bedding set comprising: a first invertible cover for enveloping a first article, wherein this first invertible cover is formed by a first side that, itself, has inner and outer surfaces and an opposing second side that, itself, has inner and outer surfaces, wherein the first side inner, first side outer, second side inner, and second side outer surfaces are each designed substantially different from each other; and a second invertible cover for enveloping a second article, wherein this second invertible cover is formed by a first side that, itself, has inner and outer surfaces and an opposing second side that, itself, has inner and outer surfaces, and wherein the first side inner, first side outer, second side inner, and second side outer surfaces of this second invertible cover are each designed substantially different from each other.

14. The bedding set of claim 13, wherein at least one of said invertible covers is adapted to envelop a comforter.

15. The bedding set of claim 13, wherein at least one of said invertible covers is adapted to envelop a pillow.

16. The bedding set of claim 13, wherein the substantial differences in the respective designs of the first side inner, first side outer, second side inner, and second side outer surfaces of at least one of said invertible covers are coloration differences.

17. The bedding set of claim 13, wherein the substantial differences in the respective designs of the first side inner, first side outer, second side inner, and second side outer surfaces of at least one of said invertible covers are graphic design differences.

18. The bedding set of claim 13, further comprising trim disposed along meeting lines of the first and second sides of at least one of said invertible covers.

19. The bedding set of claim 13, wherein the first and second sides of at least one of said invertible covers are each formed of discrete layers of fabric.

* * * * *